United States Patent [19]

DeBoer et al.

[11] Patent Number: 5,051,653

[45] Date of Patent: Sep. 24, 1991

[54] SILICON DIOXIDE SELECTIVELY REFLECTING LAYER FOR MERCURY VAPOR DISCHARGE LAMPS

[75] Inventors: Barry G. DeBoer, Georgetown; Sharon B. Rutfield, Chelmsford, both of Mass.

[73] Assignee: GTE Products Corporation, Danvers, Mass.

[21] Appl. No.: 199,152

[22] Filed: Jun. 2, 1988

Related U.S. Application Data

[63] Continuation-in-part of Ser. No. 62,262, Jun. 12, 1987, abandoned.

[51] Int. Cl.[5] ..... H01J 1/70

[52] U.S. Cl. ..... 313/489; 313/487

[58] Field of Search ..... 313/486, 488, 489, 487

[56] References Cited

U.S. PATENT DOCUMENTS

| | | | |
|---|---|---|---|
| 2,295,626 | 9/1942 | Beese | 176/122 |
| 3,205,394 | 9/1965 | Ray | 313/489 |
| 3,255,373 | 6/1966 | Van Broekhoven et al. | 313/486 |
| 3,728,721 | 4/1983 | Lee et al. | 340/554 |
| 3,754,254 | 8/1973 | Jinman | 340/554 |
| 4,051,472 | 9/1977 | Albanese et al. | 340/554 |
| 4,079,288 | 3/1978 | Maloney et al. | 313/489 |
| 4,344,016 | 8/1982 | Hoffmann et al. | 313/489 |
| 4,459,689 | 7/1984 | Biber | 367/93 |
| 4,638,294 | 1/1987 | Sakurai | 340/63 |
| 4,691,140 | 9/1987 | Sakakibara et al. | 313/486 |

FOREIGN PATENT DOCUMENTS

| | | | |
|---|---|---|---|
| 133769 | 10/1979 | Japan . | |
| 57247 | 5/1981 | Japan . | |
| 154454 | 8/1985 | Japan | 313/489 |
| 91847 | 5/1986 | Japan . | |

OTHER PUBLICATIONS

Recent Literature on Aerosil ®.

*Primary Examiner*—Donald J. Yusko
*Assistant Examiner*—Michael Horabik
*Attorney, Agent, or Firm*—Martha Ann Finnegan; Robert E. Walter

[57] ABSTRACT

An improved mercury vapor discharge lamp is disclosed. The lamp of the present invention includes an envelope and a selectively reflecting silicon dioxide layer on at least a portion of the inner surface of the envelope. The lamp further includes a phosphor coating disposed on the selectively reflecting layer. The silicon dioxide layer has a coating weight of from about 0.1 to about 4 mg/cm$^2$. The selectively reflecting layer comprises at least about 80 weight percent silica having a primary particle size from about 5 to about 100 nm with at least about 50 weight percent of the silica having a primary particle size from about 17 to about 80 nm.

3 Claims, 6 Drawing Sheets

SILICON DIOXIDE SELECTIVELY REFLECTING LAYER FOR MERCURY VAPOR DISCHARGE LAMPS

CROSS-REFERENCE TO RELATED APPLICATION

This application is a continuation-in-part of application Ser. No. 062,262 filed on June 12, 1987 now abandoned.

BACKGROUND OF THE INVENTION

The present invention relates to mercury vapor discharge lamps and more particularly to mercury vapor discharge lamps including a reflector layer.

Various coatings of non-luminescent particulate materials have been found to be useful when applied as an undercoating for the phosphor layer in both fluorescent and other mercury vapor lamps. In both types of lamp, the phosphor coating is disposed on the inner surface of the lamp glass envelope in receptive proximity to the ultraviolet radiation being generated by the mercury discharge.

Examples of non-luminescent particulate materials which have been used as reflector layers in fluorescent lamps such as, for example, aperture fluorescent reprographic lamps, include titanium dioxide, mixtures of titanium dioxide and up to 15 weight percent aluminum oxide; zirconium oxide; aluminum oxide; aluminum; and silver. Titanium dioxide is typically used to form the reflector layer in commercially available aperture fluorescent reprographic lamps.

In some instances a layer of non-luminescent particulate material is used to permit reduction in the phosphor coating weight. See, for example, U.S. Pat. No. 4,079,288 to Maloney et al., issued on 14 March 1978. U.S. Pat. No. 4,074,288 discloses employing a reflector layer comprising vapor-formed spherical alumina particles having an individual particle size range from about 400 to 5000 Angstroms in diameter in fluorescent lamps to enable reduction in phosphor coating weight with minor lumen loss. The lamp data set forth in the patent, however, shows an appreciable drop in lumen output at 100 hours.

U.S. Pat. No. 4,344,016 to Hoffman et al., issued on 10 August 1982 discloses a low pressure mercury vapor discharge lamp having an $SiO_2$ coating having a thickness of 0.05 to 0.7 mg/cm$^2$. U.S. Pat. No. 4,344,016 expressly provides that the use of thicker coatings causes a reduction in the luminous efficacy due to the occurrence of an absorption of the visible light.

SUMMARY OF THE INVENTION

In accordance with the present invention, there is provided a mercury vapor discharge lamp comprising a lamp envelope having an inner surface; a discharge assembly; a selectively reflecting layer disposed on at least a portion of the inner surface of the lamp envelope at a coating weight from about 0.1 to about 4 mg/cm$^2$, the selectively reflecting layer comprising at least about 80 weight percent silica having a primary particle size from about 5 to about 100 nm with at least about 50 weight percent of the silica having a primary particle size from about 17 to about 80 nm; and a phosphor coating disposed over at least the selectively reflecting layer.

Figure 1:
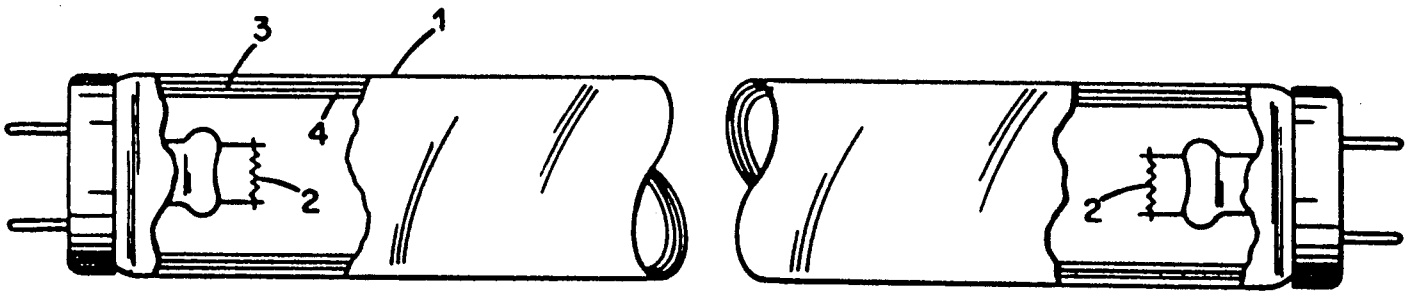
FIG. 1 is an elevational view of a fluorescent lamp, partly in cross section, in accordance with one embodiment of the present invention.

For a better understanding of the present invention, together with other and further objects, advantages, and capabilities thereof, reference is made to the following disclosure and appended claims in connection with the above-described drawings.

DETAILED DESCRIPTION

In accordance with the present invention, it has been found that the performance of mercury vapor discharge lamps can be improved by including a selectively reflecting layer comprising particles of silica (also referred to herein as silicon dioxide) and having a coating weight from about 0.1 to about 4 milligrams per square centimeter. The selectively reflecting layer is situated between the envelope and overlying phosphor coating. The selectively reflecting layer of the present invention diffusely reflects light by means of one or more scattering events, reflects short-wavelength ultraviolet light to a greater degree than longer-wavelength visible light, and absorbs as little as practicable of the incident light of either type. Apart from the small fraction absorbed, any portion of the incident light that is not reflected is transmitted through the layer.

For example, a silicon dioxide layer according to the present invention, having a weight of 1 mg/cm$^2$ reflects at least about 83% of the ultraviolet light from the discharge that penetrates the phosphor layer, back into the phosphor layer; and a layer having a weight of 4 mg/cm$^2$ reflects greater than or equal to about 94% of that light back into the phosphor layer. The silicon dioxide layers of the present invention transmit from about 35% to about 96% of the visible light emitted by the phosphor. Since the phosphor and silica layers absorb very little of the emitted visible light, a large fraction of the reflected visible light escapes from the lamp as useful output in subsequent encounters with the phosphor and silica layers. Conversely, the exciting ultraviolet light is strongly absorbed by the phosphor and is much attenuated by each additional transit of the phosphor layer.

As provided above, the coating weight for the selectively reflecting silicon dioxide layer is from about 0.1 to about 4 milligrams/square centimeter.

The optimum thickness of the selectively reflecting silica layer in a particular application is determined by the optical absorption and scattering properties of the phosphor layer to be used with respect to both the exciting and emitted light, as well as whether the maximum visible light output or the maximum reduction in phosphor weight is desired. For typical commercial lamp phosphors, it is expected that a selectively reflecting silica layer of about 2.5 mg/cm$^2$ will give the maximum light output, while a selectively reflecting silica layer in the range of about 2.0 to about 4.0 mg/cm$^2$ will permit the maximum phosphor economy at a fixed light output. Approximately half of the maximum saving of phosphor is expected with a selectively reflecting silica layer having a thickness of about 0.4 mg/cm$^2$, the exact amount being dependent upon the particular phosphor's optical absorption and scattering properties.

However, it has been unexpectedly found that substantial phosphor savings may be realized with silica layer densities as low as 0.1 mg/cm$^2$. This appears to be due to the avoidance of visible light trapping in the glass bulb wall, avoiding the associated excess absorption of that visible light.

The silicon dioxide particles used to form the selectively reflecting silicon dioxide layer, or coating, are high purity silicon dioxide, e.g., the silicon dioxide particles preferably comprise at least 99.0% by weight $SiO_2$. Most preferably, the silicon dioxide particles comprise greater than or equal to 99.8% by weight $SiO_2$. The weight percent silicon dioxide represents the degree of purity of the silicon oxide used.

At least about 80 weight percent of the silicon dioxide particles used to form the selectively reflecting layer of the present invention have a primary particle size from about 5 to about 100 nm with at least 50 weight percent of the silica having a primary particle size from about 17 to about 80 nm. Preferably, at least about 80 weight percent of the silica particles has a primary particle size from about 17 to about 80 nm. Most preferably, the preferred particle size distribution peaks at about 50 nm.

The mercury vapor discharge lamp of the present invention may be, for example, a high pressure mercury vapor discharge lamp or a fluorescent lamp.

In accordance with one embodiment of the present invention, such selectively reflecting silicon dioxide layer is included in a fluorescent lamp. A fluorescent lamp in accordance with the present invention includes an envelope; a discharge assembly including a pair of electrodes sealed in the envelope and a fill comprising an inert gas at a low pressure and a small quantity of mercury; a selectively reflecting silicon dioxide coating deposited on at least a portion of the inner surface of the lamp envelope and a phosphor coating deposited over the selectively reflecting layer. The phosphor coating may be further disposed on any uncoated portion of the inner surface of the lamp envelope. In a preferred embodiment, the selectively reflecting layer is deposited over the entire inner surface of the lamp envelope.

As used herein, the term "fluorescent lamp" refers to any lamp containing a phosphor excited to fluorescence by ultraviolet radiation, regardless of configuration.

The fluorescent lamp of the present invention may optionally include additional coatings for various other purposes.

Referring to FIG. 1, there is shown an example of a fluorescent lamp embodiment of the present invention. The fluorescent lamp shown in FIG. 1 comprises an elongated glass, e.g., soda lime silica glass, envelope 1 of circular cross-section. It has the usual electrodes 2 at each end of the envelope 1 supported on lead-in wires. The sealed envelope, or tube, is filled with an inert gas, such as argon or a mixture of inert gases, such as argon and neon, at a low pressure, for example 2 torr; and a small quantity of mercury is added, at least enough to provide a low vapor pressure of, for example, about six (6) microns during operation. Disposed on the inner surface of the envelope 1 is a selectively reflecting silicon dioxide layer 3 in accordance with the present invention. A phosphor layer 4 is coated over the reflective silicon dioxide coating.

The silicon dioxide reflecting layer can be applied to the envelope by fully coating the inner lamp surface with an organic-base suspension of the above-described silica particles, (including typical binders, surfactants, and solvents). The use of an organic base coating suspension may, however, be accompanied by flaking or peeling away of the coating when used to apply thicker coatings, e.g., over 2.5 mg/cm$^2$.

Such flaking or peeling problems are inhibited when the silicon dioxide reflecting layer of the present invention is applied to the envelope from a water-base suspension of the above-described silicon dioxide particles. The water-base coating suspension is described in more complete detail in U.S. patent application Ser. No. 062,263 of Cheryl A. Ford entitled "Fine Particle Size Powder Coating Suspension and Method" filed on even date herewith and assigned to the present assignee, the specification of which is incorporated herein by reference. The suspension further includes a negative charge precursor, for example, an aqueous base, such as ammonium hydroxide, to provide a homogeneous dispersion of the silicon dioxide particles in the coating suspension, a first binder, such as poly(ethylene oxide), a second binder, such as hydroxyethylcellulose, a defoaming agent, a surface active agent, an insolubilizing agent, and a plasticizing agent. The coated envelope is then heated to cure the coating during the bulb drying step. The phosphor coating is applied thereover by conventional lamp processing techniques.

More particularly, a water-base silica reflecting coating suspension is prepared by mixing the above-described silica with a mixture of deionized water, ammonium hydroxide, a defoaming agent, a surface active agent, an insolubilizing agent, and a plasticizer to form a slurry. The two water-soluble binders are preferably added to the slurry in solution form.

An example of a water-base coating suspension useful in applying a selectively reflecting layer in accordance with the present invention is prepared from the following components:

| | |
|---|---|
| 150 cc | deionized water |
| 12 cc | ammonium hydroxide Reagent Grade Assay (28–31%) |
| 0.28 cc | defoaming agent (Hercules type 831) |
| 0.028 cc | surfactant (BASF type 25R-1 Pluronic) |
| 2.5 cc | glycerine |
| 0.45 g | dimethylolurea |
| 150 g | Aerosil$^R$ OX-50 (obtained from DeGussa, Inc.) |
| 100 cc | hydroxyethylcellulose soltuion containing 1.7 weight percent of the resin (Natrosol (HEC) grade 250 MBR obtained from Hercules) in water |
| 600 cc | poly (ethylene oxide) solution containing 2.2 weight percent of the resin (WSRN 2000 obtained from Union Carbide) in water |

Preferably, the foregoing components are mixed together in the order listed.

Reflectance measurements were conducted on samples of fine particle silica coated to various thicknesses on glass slides using an organic based suspension. The slides were prepared by hand mixing small amounts of the fine silica with an organic vehicle similar to that used in preparing organic-based coating suspensions of phosphors. The organic vehicle included xylene, butanol, and ethylcellulose. The suspension was thinned as needed with additional xylene. The coating suspension was applied to the microscope slides which were then allowed to drain and dry in a vertical position. The coated slides were baked in air at about 500° C. for 3 to 5 minutes to burn off the organic components. For heavier layers, the process was repeated or a higher concentration of silica was used.

Figure 2:
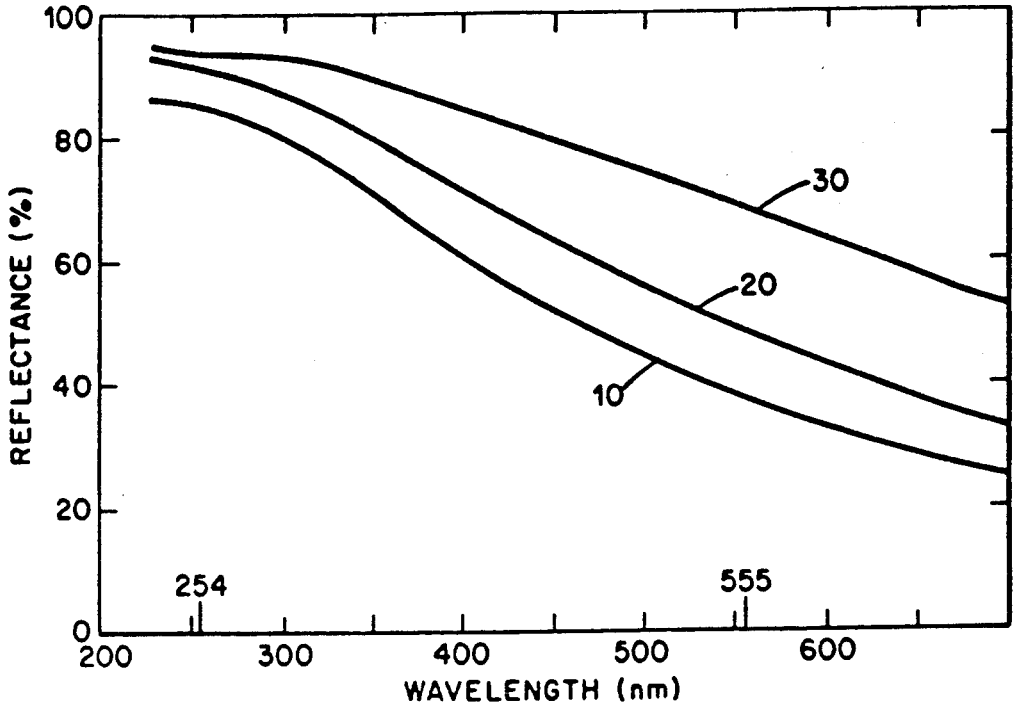
FIG. 2 graphically represents reflectance measurements of a silicon dioxide coating in accordance with the present invention as a function of wavelength at different coating thicknesses.

The results are graphically represented in FIG. 2. Curve 10 illustrates reflectance measurements for a silica layer having a density of 1.23 mg/cm$^2$; curve 20 illustrates reflectance measurements for a silica layer having a density of 2.21 mg/cm$^2$; and curve 30 illustrates reflectance measurements for a silica layer having a density of 4.50 mg/cm$^2$. The fine silica used to obtain the reflectance measurements was Aerosil ® OX-50 obtained from DeGussa, Inc. Aerosil ® OX-50 is a fluffy white powder that has a BET surface area of 50±15 m$^2$/g. The average primary particle size of OX-50 is 40 nm. Aerosil ® OX-50 contains greater than 99.8 percent $SiO_2$, less than 0.08% $Al_2O_3$, less than 0.01% $Fe_2O_3$, less than 0.03 $TiO_2$, less than 0.01% HCl.

Figure 3:
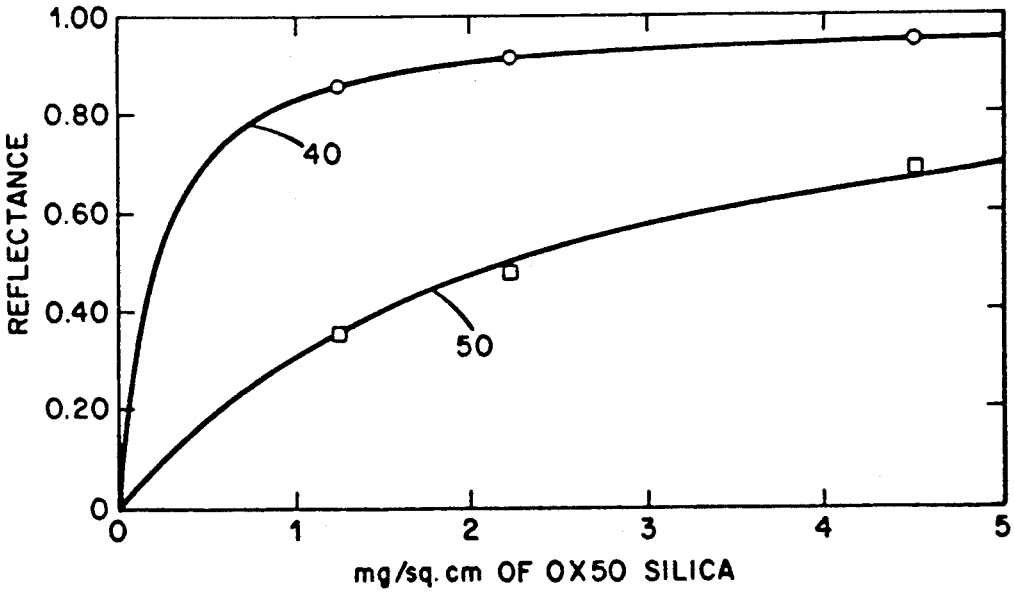
FIG. 3 graphically represents the expected variation of reflectance as a function of coating thickness for a selectively reflecting silicon dioxide layer, for two different wavelengths.

While FIG. 2 illustrates experimental values, FIG. 3 illustrates calculated values for the expected reflectance of layers of OX-50 as a function of layer thickness. In FIG. 3, Curve 40 illustrates expected reflectance as a function of layer thickness for 254 nm wavelength of light. Curve 50 illustrates the expected reflectance as a function of OX-50 layer thickness (mg/cm$^2$) for 555 nm wavelength of light.

EXAMPLE 1

A lamp test was conducted using 40 watt T12 fluorescent lamps. Two sets of lamps were fabricated and tested. The first set consisted of seven (7) groups of lamps, Groups A–G, containing either 3 or 4 lamps per group, in which phosphor coatings of various densities (weight/area) were applied directly to the bare inner surface of the lamp envelope. The phosphor used in the lamp tests was a standard warm white color triphosphor blend including, by weight, 4.6% blue-emitting europium-activated barium magnesium aluminate, 32.4% green-emitting cerium terbium magnesium aluminate, and 63.1% red-emitting europium-activated yttrium oxide.

The second set consisted of six (6) groups of five lamps each, Groups H–M. In each of the six groups, a selectively reflecting silicon dioxide layer consisting of Aerosil ® OX-50 and having a density of 1.7 mg/cm$^2$ was applied to the entire inner surface of the lamp envelope. Phosphor coatings of various densities were applied over the reflecting layer in each of the six groups. The same batch of warm white color triphosphor coating suspension was used to form the phosphor layers in both sets of lamps, both with and without the selectively reflecting layers.

Figure 4:
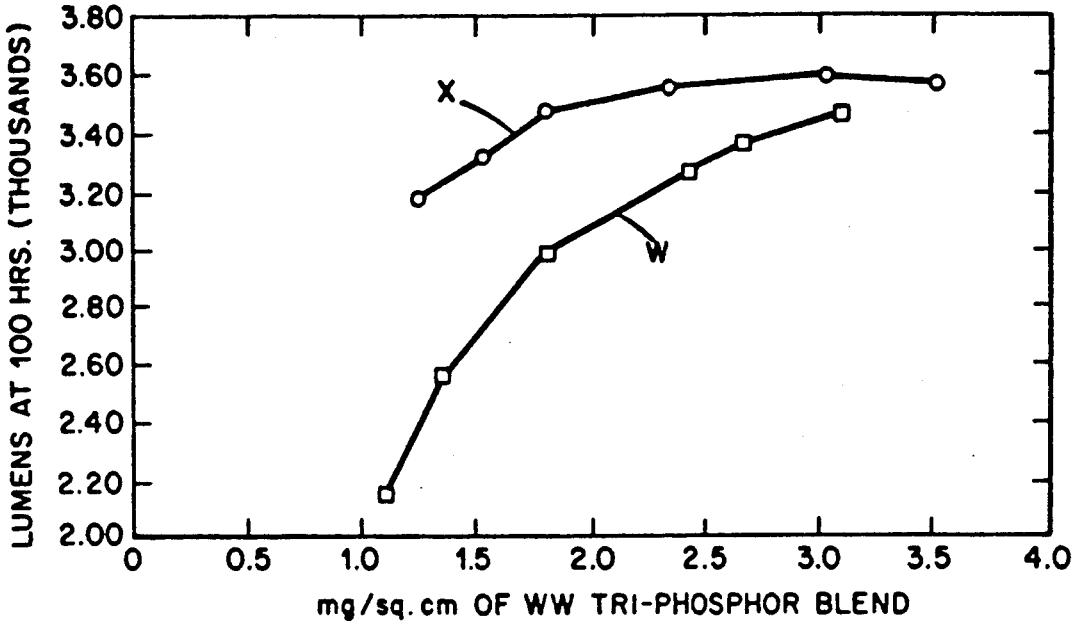
FIG. 4 graphically represents lumens as a function of the density of a triphosphor blend in lamps made with and without the selectively reflecting silicon dioxide layer of the present invention.

The results from the above-described lamp tests are presented in Table I, below. The 100 hours lamp data given in Table I is graphically represented in FIG. 4. Curve W represents the results for Lamps A–G (the control group). Curve X represents the results for Lamps H–M.

TABLE I

| LAMP GROUP | NO. OF LAMPS | PHOSPHOR DENSITY mg/cm$^2$ | AVERAGE LUMEN OUTPUT Zero hr. (lumens) | 100-hr. (lumens) | 3139 hr. (lumens) | MAINTENANCE 0–100 hr. | 100–3139 hr. |
|---|---|---|---|---|---|---|---|
| A | 4 | 3.09 | 3489 | 3468 | 3117 | 99.4% | 89.9% |
| B | 3 | 2.67 | 3429 | 3371 | — | 98.3% | — |
| C | 3 | 2.42 | 3355 | 3271 | — | 97.5% | — |
| D | 3 | 1.80 | 3070 | 2992 | — | 97.5% | — |
| E | 3 | 1.35 | 2661 | 2545 | — | 95.6% | — |
| F | 3 | 1.11 | 2317 | 2148 | — | 92.7% | — |
| G | 3 | 1.00 | 2141 | 1975 | — | 92.2% | — |
| H | 5 | 3.51 | 3619 | 3560 | 3361 | 98.4% | 94.4% |
| I | 5 | 3.03 | 3634 | 3592 | 3352 | 98.8% | 92.3% |
| J | 5 | 2.33 | 3620 | 3559 | 3298 | 98.3% | 92.7% |
| K | 5 | 1.79 | 3546 | 3471 | 3159 | 97.9% | 92.7% |
| L | 5 | 1.52 | 3439 | 3314 | 2867 | 96.4% | 91.0% |
| M | 5 | 1.25 | 3295 | 3180 | — | 96.5% | — |

EXAMPLE 2

A second lamp test was conducted in the same fashion as the first, except that the density of the selectively reflecting silica layer was about 2.1 mg/cm$^2$ and the phosphor was a routine-production cool white, antimony and manganese-doped calcium fluoro-chlorophosphate phosphor. Three (3) groups of lamps, Groups N–P, consisting of four (4) lamps each, were coated with various densities of the phosphor, applied directly to the bare inner surface of the lamp envelope. Four (4) other groups of lamps, Groups Q–T, were first given the selectively reflecting silicon dioxide coating and baked out before having various densities of the above-identified halophosphate phosphor applied over the silicon dioxide coating. In lamp Groups Q–T, the selectively reflecting silicon dioxide layer was suspension-coated using an organic based suspension system containing xylene, butanol, ethylcellulose and surfactant. In lamp Groups N–P and Q–T, the phosphor coating was also applied using the same organic-based suspension system.

Figure 5:
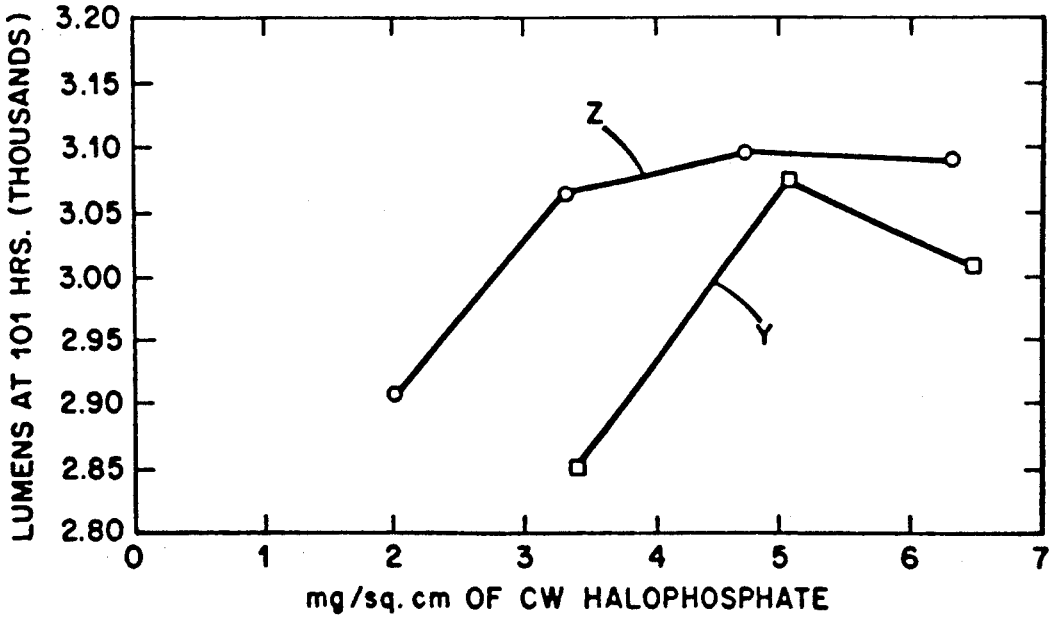
FIGS. 5–8 graphically represent lumens as a function of the density of a halophosphate phosphor in lamps made with and without the selectively reflecting silicon dioxide layer of the present invention.

The results of this lamp test are presented in Table II. The 101 hour lumen data is graphically presented in FIG. 5, where curve Y represents the results for lamp groups N–P (the control groups), and curve Z represents the results for Groups Q–T which include the selectively reflecting silicon dioxide layer, according to the present invention.

TABLE II

| LAMP GROUP | NO. OF LAMPS | PHOSPHOR DENSITY mg/cm² | AVERAGE LUMEN OUTPUT Zero hr. (lumens) | 101 hr. (lumens) | 335 hr. (lumens) | 0-101 hrs. Maintenance |
|---|---|---|---|---|---|---|
| N | 4 | 6.5 | 3147 | 3008 | 2932 | 95.6% |
| O | 4 | 5.1 | 3300 | 3074 | 2983 | 96.1% |
| P | 4 | 3.4 | 3113 | 2852 | 2788 | 91.6% |
| Q | 4 | 6.3 | 3208 | 3089 | 2932 | 96.3% |
| R | 4 | 4.7 | 3238 | 3096 | 2992 | 95.6% |
| S | 4 | 3.3 | 3313 | 3065 | 2976 | 92.5% |
| T | 4 | 2.0 | 3155 | 2907 | 2780 | 92.1% |

Although the above-described tests involve a warm white triphosphor blend and a halophosphate phosphor, the present invention can advantageously be utilized with any other phosphor or phosphor blend.

Among other purposes, the present invention may be employed to compensate for the brightness loss caused by the use of a glass not including antimony (about 1-2%) and/or the elimination of cadmium from halophosphate phosphors (about 2%).

Accordingly, the present invention is particularly advantageous for use in fluorescent lamps which include an antimony-free glass envelope and/or a cadmium-free halophosphate phosphor. For example, the application of a selectively reflecting silica layer beneath a cadmium-free halophosphate layer accounts for an approximately 100% recuperation of brightness losses associated with such halophosphates.

In an embodiment of the present invention including an antimony-free glass envelope and/or cadmium-free halophosphate phosphor, the selectively reflecting layer is applied to the glass envelope at a coating density of about 0.1 to about 0.6 mg/cm², and preferably 0.45 mg/cm², prior to the application of the phosphor layer. The use of the selectively reflecting layer in this embodiment increases the total lumen output up to about 3%. The increased lumen output permits a phosphor powder weight reduction per lamp of up to 30% with no loss in lamp brightness. A cost savings is also realized.

EXAMPLE 3

A series of experiments was carried out employing fluorescent lamps. The experiment involved twelve (12) groups of fluorescent lamps of the 40 Watt T12 type. Each of the twelve groups contained four (4) lamps. Each fluorescent lamp in this experimental series included a selectively reflecting layer having a coating weight in the range of from about 0.5 to about 1.3 mg/cm² and a layer of cool white halophosphate phosphor (containing cadmium) layer with a coating weight in the range of from about 2.4 to about 5.5 mg/cm². The actual coating weights for the selectively reflecting layer and phosphor layer included in each of the lamps of the series and the lumen output data for the lamps are summarized in Table III.

Figure 6:
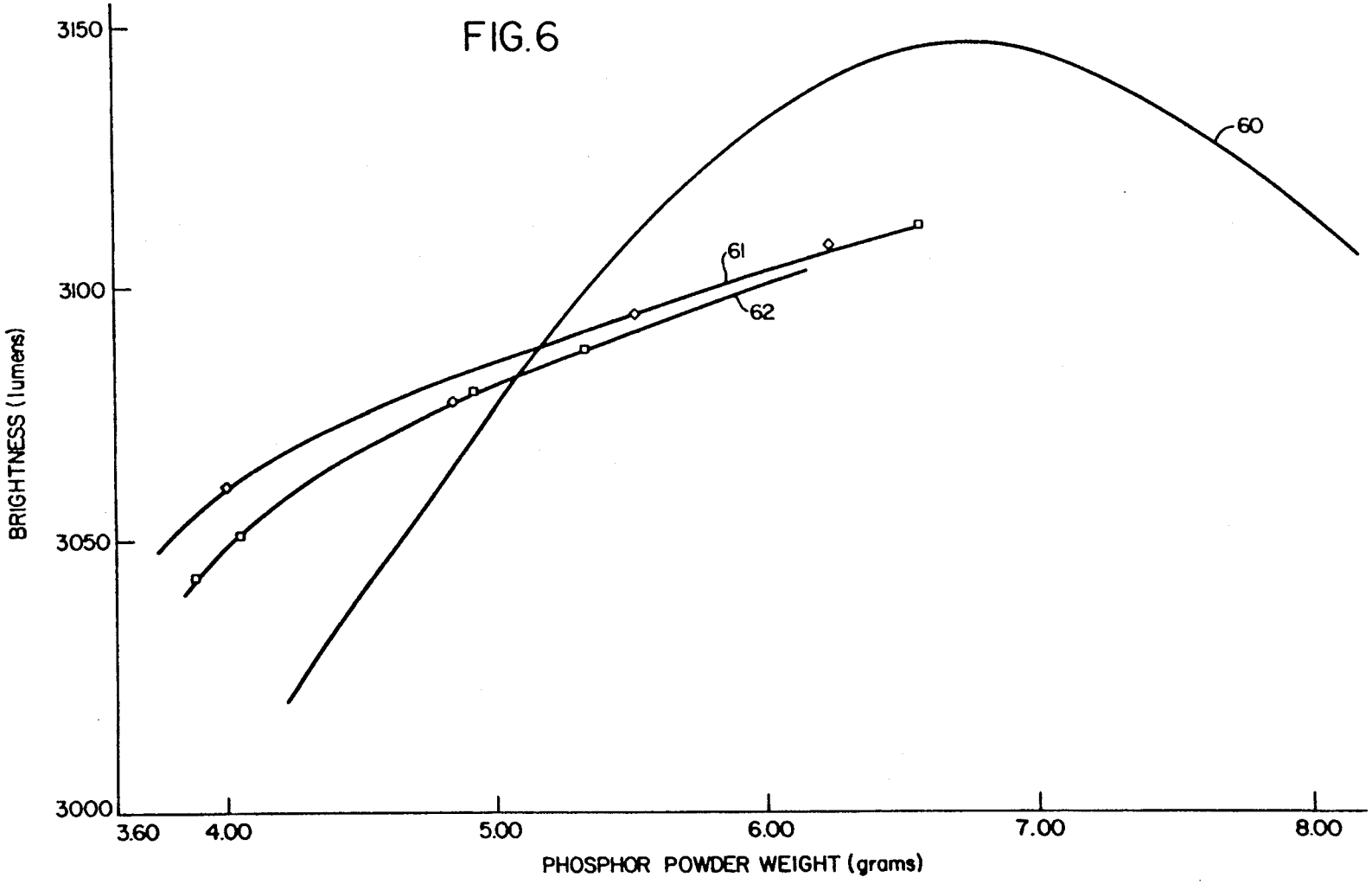

FIG. 6 graphically represents the brightness (lumens) at 102 hours as a function of phosphor coating weight for three lamp groups of this experimental series. Curve 60 represents the results for a lamp group including a selectively reflecting layer with a coating weight of about 0.53 mg/cm². Curve 61 represents the results for a lamp group including a selectively reflecting layer with a coating weight of about 0.88 mg/cm². Curve 62 represents the results for a lamp group including a selectively reflecting layer with a coating weight of about 1.30 mg/cm².

TABLE III

| Lamp Group | No. of Lamps | Reflecting Layer Density mg/cm² | Phosphor Density mg/cm² | Average Lumen Output 0 Hr | 102 Hr | 4989 Hr | Lumen Maintenance 0-102 % M | 102-4987 % M |
|---|---|---|---|---|---|---|---|---|
| U | 4 | 0.53 | 3.20 | 3221 | 3059 | 2738 | 95.0 | 89.5 |
| V | 4 | 0.53 | 3.78 | 3219 | 3111 | 2858 | 96.6 | 91.9 |
| W | 4 | 0.53 | 5.37 | 3243 | 3117 | 2753 | 96.1 | 88.3 |
| X | 4 | 0.53 | 5.05 | 3257 | 3134 | 2810 | 96.2 | 89.7 |
| Y | 4 | 0.88 | 2.72 | 3232 | 3061 | 2676 | 94.7 | 87.4 |
| Z | 4 | 0.88 | 3.30 | 3242 | 3077 | 2644 | 94.9 | 85.9 |
| AA | 4 | 0.88 | 3.76 | 3242 | 3094 | 2689 | 95.4 | 86.9 |
| BB | 4 | 0.88 | 4.25 | 3254 | 3107 | 2682 | 95.5 | 86.3 |
| CC | 4 | 1.30 | 2.64 | 3249 | 3044 | 2606 | 93.7 | 85.6 |
| DD | 4 | 1.30 | 2.75 | 3231 | 3052 | 2604 | 94.5 | 85.3 |
| EE | 4 | 1.30 | 3.35 | 3259 | 3079 | 2634 | 94.5 | 85.6 |
| FF | 4 | 1.30 | 3.63 | 3258 | 3087 | 2570 | 94.8 | 83.3 |

The selectively reflecting layer of this experimental series was composed of Aerosil OX-50.

Lamps including halophosphate phosphor and including a selectively reflecting layer with a coating weight less than about 0.69 mg/cm² demonstrated the best results in this experimental series.

EXAMPLE 4

A series of experiments was carried out employing fluorescent lamps. The experiment involved four groups of fluorescent lamps of the 40 Watt T12 type.

Each fluorescent lamp in three of the groups of this experimental series included a selectively reflecting layer having a coating weight of less than 0.69 mg/cm² and a layer of cool white halophosphate phosphor (containing cadmium) layer with a coating weight in the range of from about 3.4 to about 3.7 mg/cm².

The fourth group was a control group. Each fluorescent lamp in the control group included a layer of cool white halophosphate phosphor (containing cadmium). No selectively reflecting layer was included in the lamps of this group.

The selectively reflecting layer of this experimental series was composed of Aerosil OX-50.

The actual coating weights for the lamps of the series and the lumen output data for each lamp are summarized in Table IV.

TABLE IV

| Lamp Group | Reflecting Layer Density mg/cm² | Phosphor Density mg/cm² | Average Lumen Output 0 Hr | 98 Hr | 8010 Hr | Lumen Maintenance 0–98 % M | 98–8010 % M |
|---|---|---|---|---|---|---|---|
| GG | — | 4.39 | 3193 | 3095 | 2670 | 96.9 | 86.3 |
| HH | 0.42 | 3.49 | 3258 | 3142 | 2663 | 96.4 | 84.8 |
| II | 0.42 | 3.36 | 3249 | 3145 | 2623 | 96.8 | 83.4 |
| JJ | 0.42 | 3.72 | 3268 | 3155 | 2623 | 96.5 | 83.1 |

EXAMPLE 5

A series of experiments was carried out employing fluorescent lamps. The experiment involved thirteen groups of fluorescent lamps of the 40 Watt T12 type.

Each fluorescent lamp in twelve of the groups included a selectively reflecting layer having a coating weight in the range of from about 0.3 to about 0.64 mg/cm² and an overlying layer of cool white halophosphate phosphor (containing cadmium) layer with a coating weight in the range of from about 2.4 to about 5.5 mg/cm².

The thirteenth group of lamps was a control group. Each fluorescent lamp of the control group included a single layer of cool white halophosphate phosphor (containing cadmium). No selectively reflecting layer was included in the lamps of this group.

Figure 7:
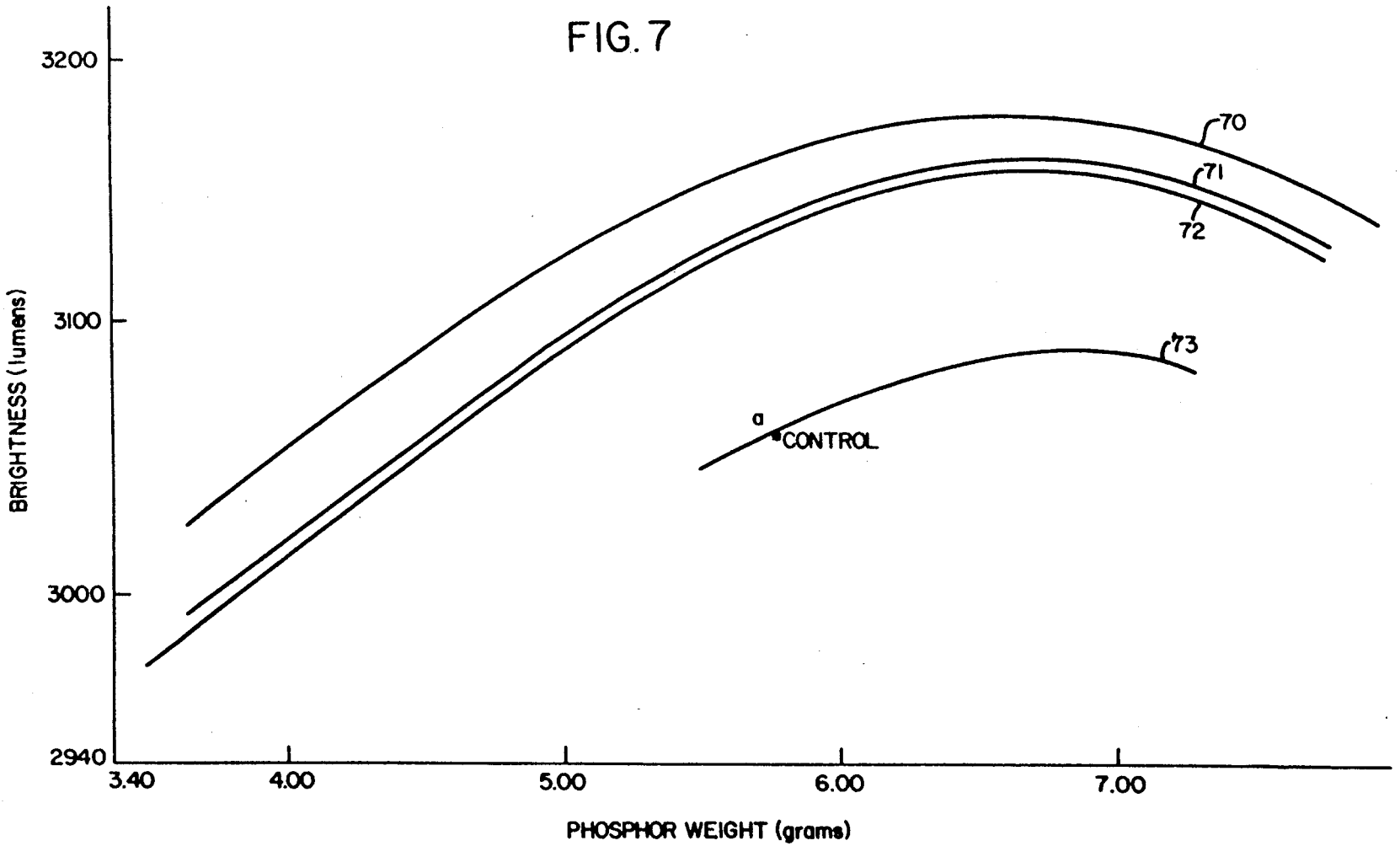

FIG. 7 graphically represents the brightness (lumens) at 102 hours as a function of phosphor coating weight for four lamp groups of this experimental series. Curve 70 represents the results for a lamp group including a selectively reflecting layer with a coating weight of about 0.47 mg/cm². Curve 71 represents the results for a lamp group including a selectively reflecting layer with a coating weight of about 0.31 mg/cm². Curve 72 represents the results for a lamp group including a selectively reflecting layer with a coating weight of about 0.64 mg/cm². Curve 73 represents the results for a lamp group including no selectively reflecting layer. (Point a on curve 73 represents the data for a lamp including the phosphor coating weight used in a standard commercial 40 Watt T12 cool white fluorescent lamp.)

The number of lamps in each group, the actual coating weights for the lamps of the series, and the lumen output data for each lamp in this series are summarized in Table V.

TABLE V

| Lamp Group | No. of Lamps | Reflecting Layer Density mg/cm² | Phosphor Density mg/cm² | Average Lumen Output 0 Hr | 102 Hr | 4989 Hr | Lumen Maintenance 0–102 % M | 102–4987 % M |
|---|---|---|---|---|---|---|---|---|
| KK | 5 | 0.64 | 2.40 | 3165 | 2971 | 2561 | 93.9 | 86.2 |
| LL | 5 | 0.64 | 2.91 | 3208 | 3044 | 2618 | 94.9 | 90.2 |
| MM | 5 | 0.64 | 2.72 | 3210 | 3031 | 2644 | 94.4 | 87.2 |
| NN | 5 | 0.64 | 4.91 | 3320 | 3142 | 2583 | 94.6 | 82.2 |
| OO | 5 | 0.47 | 2.56 | 3196 | 3036 | 2672 | 95.0 | 88.0 |
| PP | 5 | 0.47 | 2.79 | 3225 | 3061 | 2711 | 94.9 | 88.5 |
| QQ | 4 | 0.47 | 5.17 | 3283 | 3158 | 2606 | 96.2 | 82.5 |
| RR | 5 | 0.47 | 5.40 | 3283 | 3140 | 2610 | 95.6 | 83.1 |
| SS | 5 | 0.31 | 2.49 | 3166 | 2995 | 2644 | 94.6 | 88.2 |
| TT | 5 | 0.31 | 2.92 | 3191 | 3037 | 2681 | 95.2 | 88.3 |
| UU | 5 | 0.31 | 5.04 | 3314 | 3143 | 2633 | 94.8 | 83.8 |
| VV | 5 | 0.31 | 5.21 | 3288 | 3147 | 2654 | 95.7 | 84.3 |
| WW | 5 | — | 3.93 | 3234 | 3063 | 2734 | 94.7 | 89.3 |

EXAMPLE 6

A series of experiments was carried out employing fluorescent lamps. The experiment involved five groups of fluorescent lamps of the 40 Watt T12 type.

Each fluorescent lamp in four of the lamp groups included a selectively reflecting layer having a coating weight of about 0.45 mg/cm² and an overlying layer of cool white halophosphate phosphor (containing cadmium) layer with a coating weight in the range of from about 2.0 to about 4.8 mg/cm².

The fifth group of lamps was a control group. Each fluorescent lamp in the fifth lamp group included a single layer of cool white halophosphate phosphor (containing cadmium). No selectively reflecting layer was included in the lamps of this group.

Figure 8:
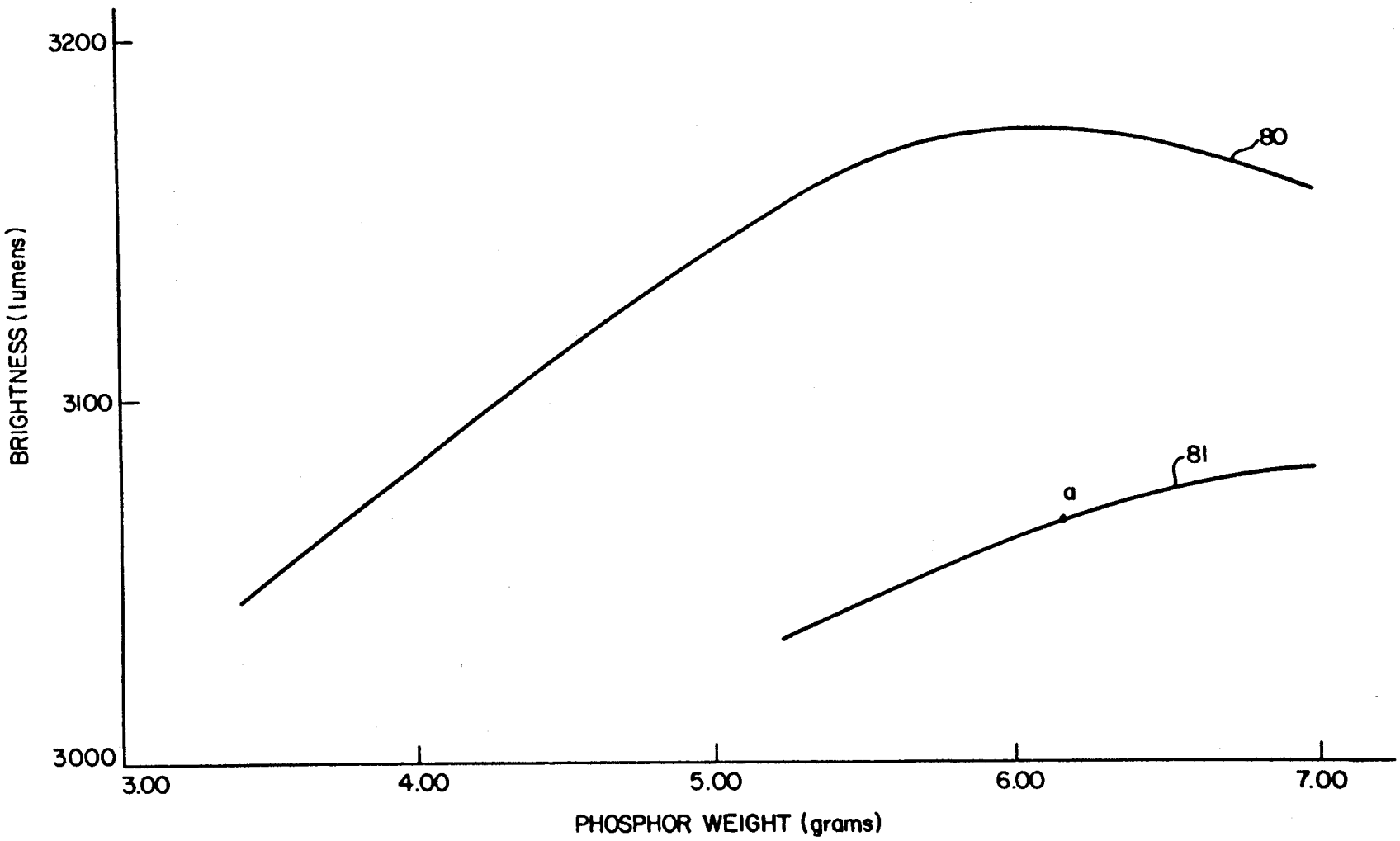

FIG. 8 graphically represents the brightness (lumens) at 102 hours as a function of phosphor coating weight for four lamps of this experimental series. Curve 80 represents the results for a lamp group including a selectively reflecting layer with a coating weight of about 0.45 mg/cm². Curve 81 represents the results for a lamp group including no selectively reflecting layer. (Point a on curve 81 represents the data for a lamp including the phosphor coating weight as is used in a standard commercial 40 Watt T12 cool white fluorescent lamp.)

The selectively reflecting layer of this experimental series was composed of Aerosil OX-50.

The number of lamps in each group, the actual coating weights for the lamps of the series, and the lumen output data for each lamp are summarized in Table VI.

EXAMPLE 7

A series of experiments was carried out employing fluorescent lamps. The experiment involved four groups of fluorescent lamps of the 40 Watt T12 type.

Each fluorescent lamp in two of the lamp groups of this experimental series included a selectively reflecting layer having a coating weight of about 0.49 mg/cm$^2$ and an overlying layer of cadmium-free cool white halophosphate phosphor.

TABLE VI

| Lamp Group | No. of Lamps | Reflecting Layer Density mg/cm$^2$ | Phosphor Density mg/cm$^2$ | Average Lumen Output 0 Hr | 102 Hr | 4989 Hr | Lumen Maintenance 0–102 % M | 102–4987 % M |
|---|---|---|---|---|---|---|---|---|
| XX | 6 | 0.45 | 4.71 | 3277 | 3157 | 2875 | 96.3 | 91.1 |
| YY | 7 | 0.45 | 3.62 | 3260 | 3158 | 2950 | 96.9 | 93.4 |
| ZZ | 7 | 0.45 | 2.94 | 3250 | 3100 | 2894 | 95.4 | 93.4 |
| AAA | 6 | 0.45 | 2.34 | 3180 | 3047 | 2831 | 95.8 | 92.9 |
| BBB | 8 | — | 3.56 | 3190 | 3043 | 2779 | 95.4 | 91.3 |

The selectively reflecting layer of this experimental series was composed of Aerosil OX-50.

Each fluorescent lamp in the other two lamp groups of this experimental series included a single layer of cadmium-containing cool white halophosphate phosphor layer. No selectively reflecting layer was included in the lamps of the second group.

The data for this lamp test is set forth in Table VII.

The results show that a selectively reflecting layer, when used with cadmium-free cool white phosphor compensates for intrinsic brightness losses associated with cadmium-free halophosphates.

The density values for the selectively reflecting layers and the phosphor layers described in Examples 3–7 and the respective Tables are based upon a surface area of 1,473 cm$^2$.

The lamps tested in Examples 3–7 employed lamp envelopes comprised of antimony-free glass.

While the foregoing lamp tests involved fluorescent, or low pressure mercury discharge lamps, it is believed that the selectively reflecting silicon dioxide layer of the present invention will provide similar advantages when employed on the inner surface of the vitreous outer envelope, or jacket, of a high pressure mercury vapor lamp, the structures of which are well known in the art. These lamps include a discharge assembly which includes a quartz arc tube. The arc tube includes a pair of spaced electrodes and a discharge-sustaining fill including mercury and an inert starting gas. These lamps also include means for electrically connecting the arc tube electrodes to a pair of lead-ins which are connected to the contacts of the base. These lamps may further include support means (e.g., a frame) for supporting the arc tube within the outer envelope.

TABLE VII

| Lamp Group | OX-50 Pre-Coat Wt. (grams) | No. of Lamps | Cool White Wt. (grams) | Total Density | 0 Hr | 105 Hr | 489 Hr | 2999 Hr | 105–2999 % M |
|---|---|---|---|---|---|---|---|---|---|
| CCC | — | 5 | 5.11 | 78.5 | 3156 | 3075 | 3003 | 2796 | 90.9 |
| DDD | — | 7 | 6.20 | 78.3 | 3111 | 3036 | 2949 | 2745 | 90.4 |
| EEE | 0.71 | 6 | 5.87 | 78.7 | 3261 | 3138 | 3061 | 2861 | 91.2 |
| FFF | 0.71 | 6 | 5.09 | 78.0 | 3228 | 3127 | 3033 | 2825 | 90.3 |

A significant portion of the radiant energy generated by the mercury arc of a high pressure mercury vapor type lamp is in the ultraviolet region. Phosphor coatings are used in these lamps to convert some of the ultraviolet light to visible light. Red or red-orange-emitting phosphors or phosphor blends, especially europium-doped yttrium vanadate or phosphovanadates, are typically used in high pressure mercury vapor type lamps to improve the efficacy and color rendition of the lamp output. In accordance with the present invention, a selectively reflecting silicon dioxide layer is interposed between the inner surface of the outer jacket and the phosphor layer.

While there have been shown and described what are considered preferred embodiments of the present invention, it will be apparent to those skilled in the art that various changes and modifications may be made therein without departing from the invention as defined by the appended Claims.

What is claimed is:

1. A fluorescent lamp comprising:

a lamp envelope having an inner surface;

a selectively reflecting layer comprising silica disposed on at least a portion of said inner surface of said envelope at a coating weight from about 0.1 to about 4 mg/cm$^2$, said selectively reflecting layer comprising at least about 80 weight percent silica having a primary particle size from about 5 to about 100 nm with at least about 50 weight percent of said silica having a primary particle size from about 17 to about 80 nm;

a phosphor coating disposed over said selectively reflecting layer and on any uncoated portion of said inner surface of said lamp; and said selectively reflecting layer contains greater than or equal to 1.0 mg/cm$^2$ of silica.

2. A fluorescent lamp in accordance with claim 1 wherein said selectively reflecting layer contains about 2.0 to about 4.0 mg/cm$^2$ of silica.

3. A fluorescent lamp in accordance with claim 1 wherein said selectively reflecting layer contains about 2.5 mg/cm$^2$ of silica.

* * * * *